US007335118B1

(12) United States Patent
Sung

(10) Patent No.: US 7,335,118 B1
(45) Date of Patent: Feb. 26, 2008

(54) SHOCK ABSORBING AND SOUND PRODUCING DEVICE FOR TENNIS RACKET

(76) Inventor: Hung-Fu Sung, No. 17, Lane 210, Chung Yang Rd., Feng Yuan, Taichung Hsien (TW) 420

( * ) Notice: Subject to any disclaimer, the term of this patent is extended or adjusted under 35 U.S.C. 154(b) by 0 days.

(21) Appl. No.: 11/634,193

(22) Filed: Dec. 6, 2006

(51) Int. Cl.
*A63B 69/38* (2006.01)

(52) U.S. Cl. ..... 473/461; 473/553; 473/522

(58) Field of Classification Search ..... 473/553, 473/461, 522
See application file for complete search history.

(56) References Cited

U.S. PATENT DOCUMENTS 4,094,504 A * 6/1978 Barasch ..... 473/461
4,535,986 A * 8/1985 Richards ..... 473/553
4,852,875 A * 8/1989 McLennan et al. ..... 473/461
4,909,509 A * 3/1990 Boschian ..... 473/522
4,927,143 A * 5/1990 Hillock ..... 473/522
5,022,651 A * 6/1991 Barone ..... 473/522
5,340,102 A * 8/1994 Adamson et al. ..... 473/461
5,776,020 A * 7/1998 Barone ..... 473/522
5,792,011 A * 8/1998 Kuebler ..... 473/520
5,871,409 A * 2/1999 Kimoto ..... 473/522
7,014,579 B1 * 3/2006 Sung ..... 473/522
2002/0183129 A1 * 12/2002 Koncelik, Jr. ..... 473/234
2003/0195063 A1 * 10/2003 Koncelik, Jr. ..... 473/459

* cited by examiner

*Primary Examiner*—Raleigh W. Chiu
(74) *Attorney, Agent, or Firm*—Bacon & Thomas, PLLC

(57) ABSTRACT

A device mounted in a tennis racket includes a cylindrical cushioning member including an annular groove, a central chamber, an axial channel crossed the chamber, and two recesses at its both ends; and a rigid, doughnut-shaped, hollow sound producing member mounted in the chamber and including a space and an axial tunnel therethrough. Three straight wires of a network of the racket pass three sides of the groove for fastening the device such that the device can absorb reaction when a ball is hit by the racket. The strength of sound produced by the device is determined by whether air flowing through one recess, one end of the channel, and the tunnel co-acts with air in the space to produce resonance or not by whether a handle held by the hand correctly hits the ball or not. The recess has a concave, convex, or inclined section around its central portion.

6 Claims, 9 Drawing Sheets

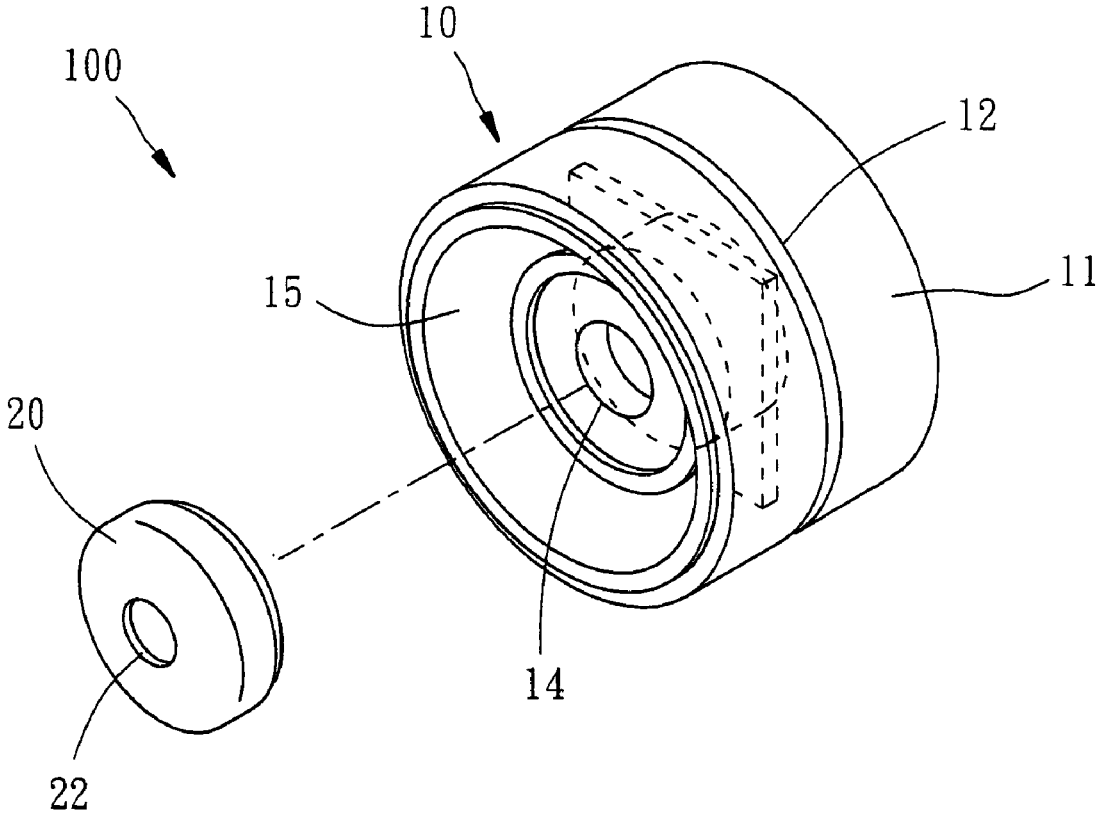
Fig・1

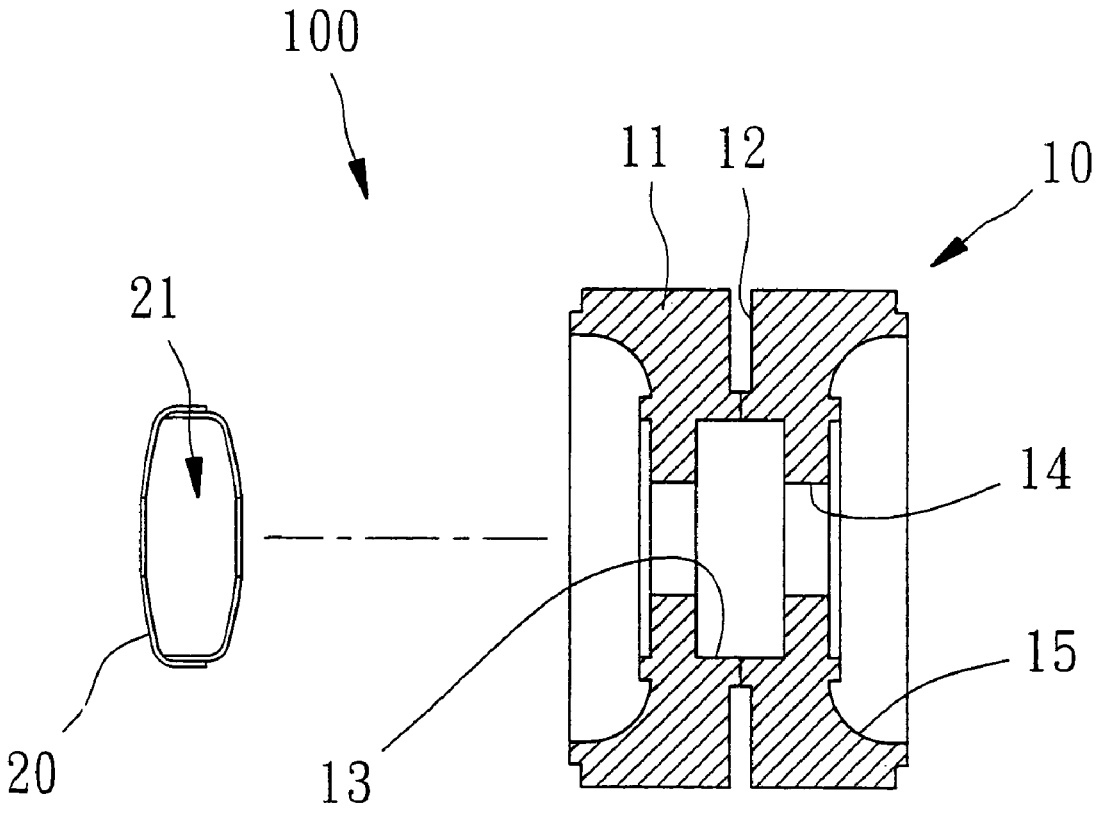
Fig・2

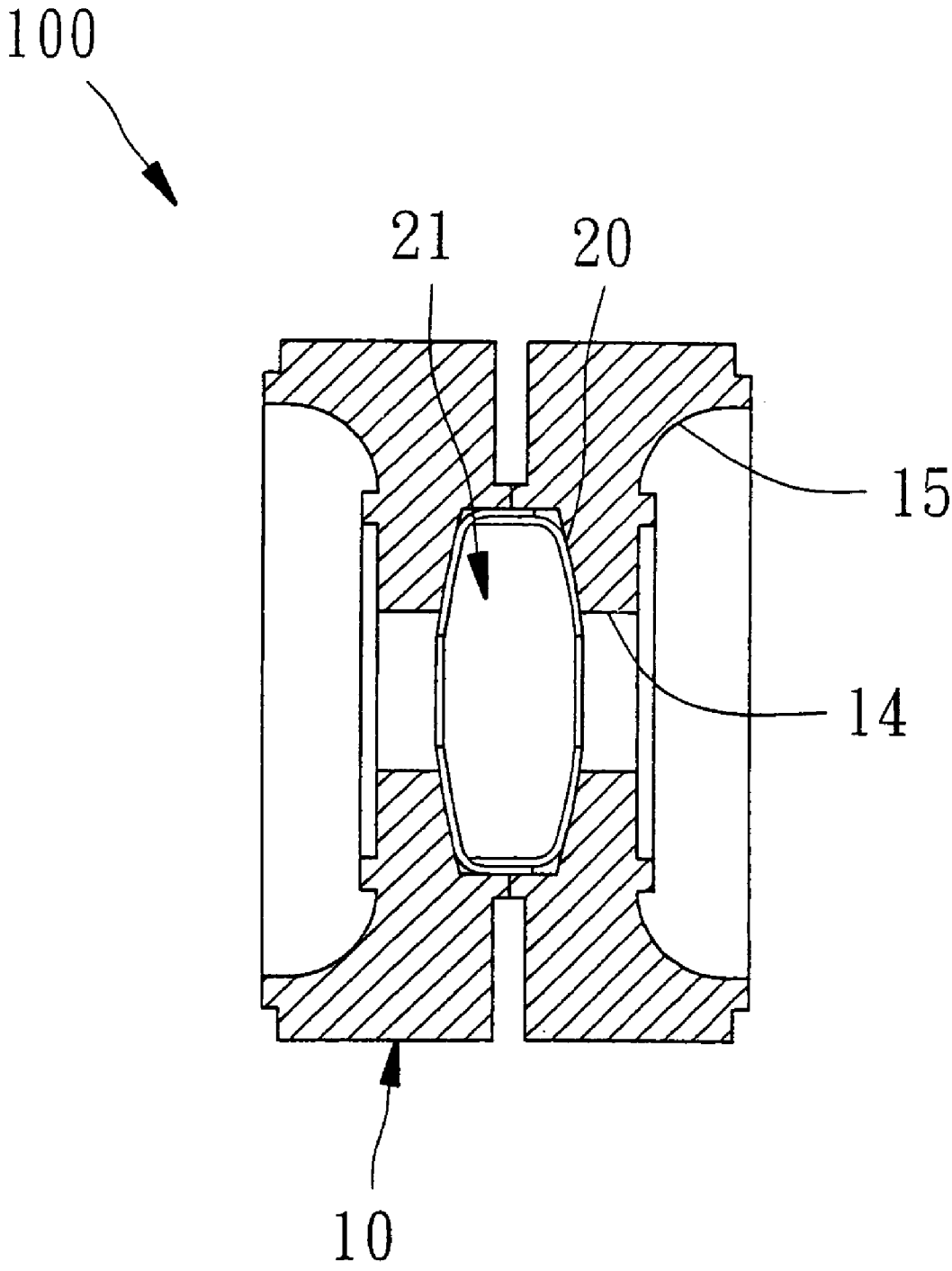
Fig・3

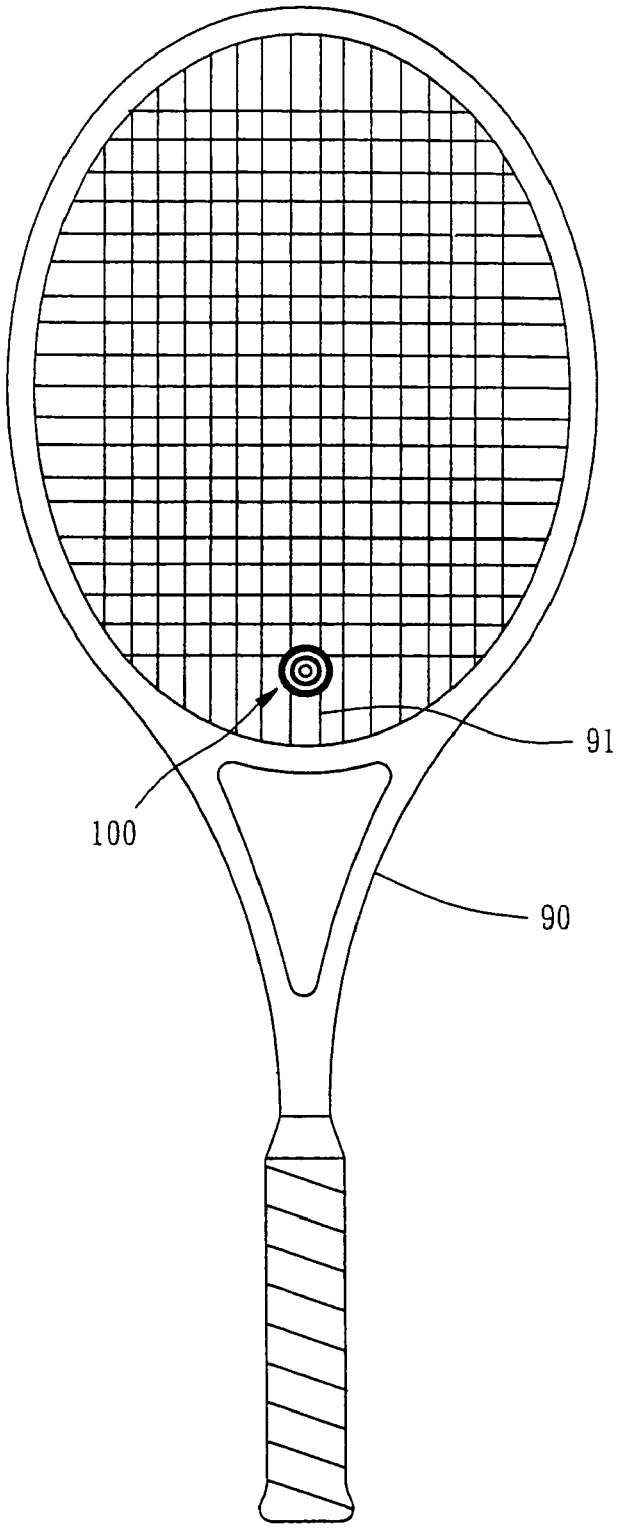
Fig・4

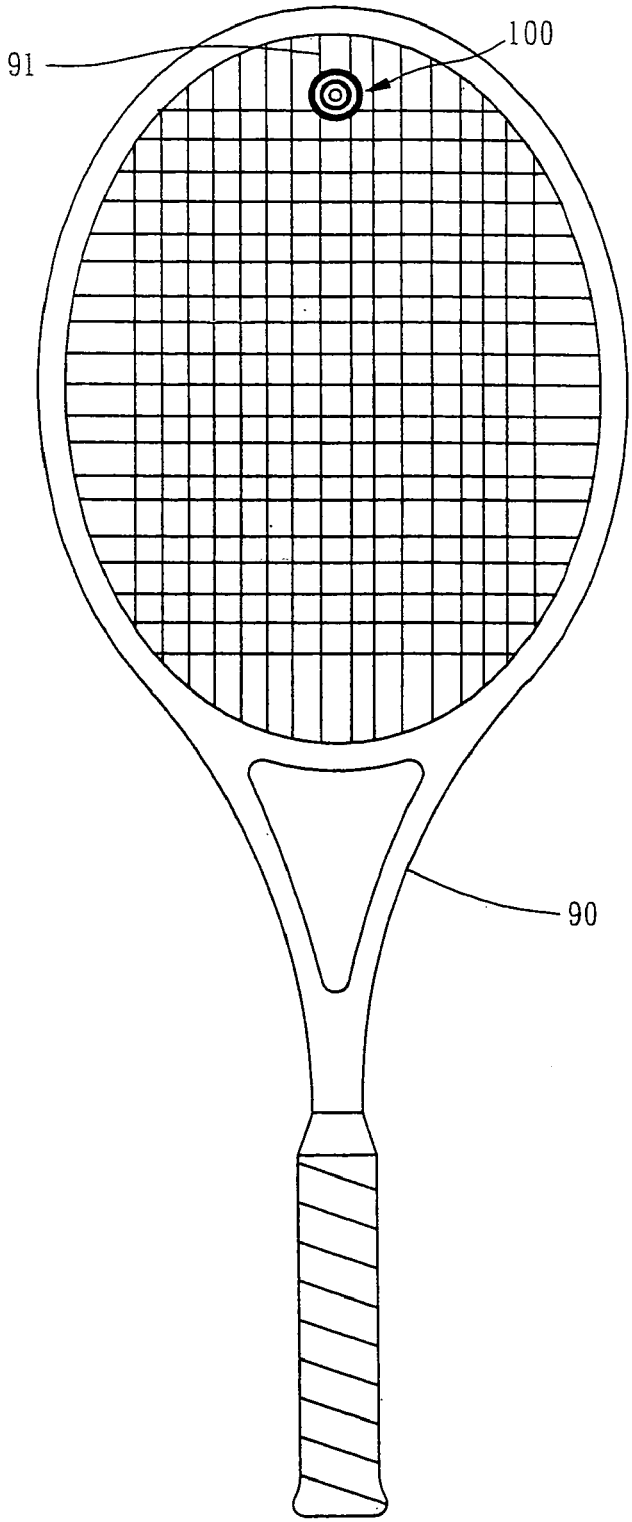
Fig・5

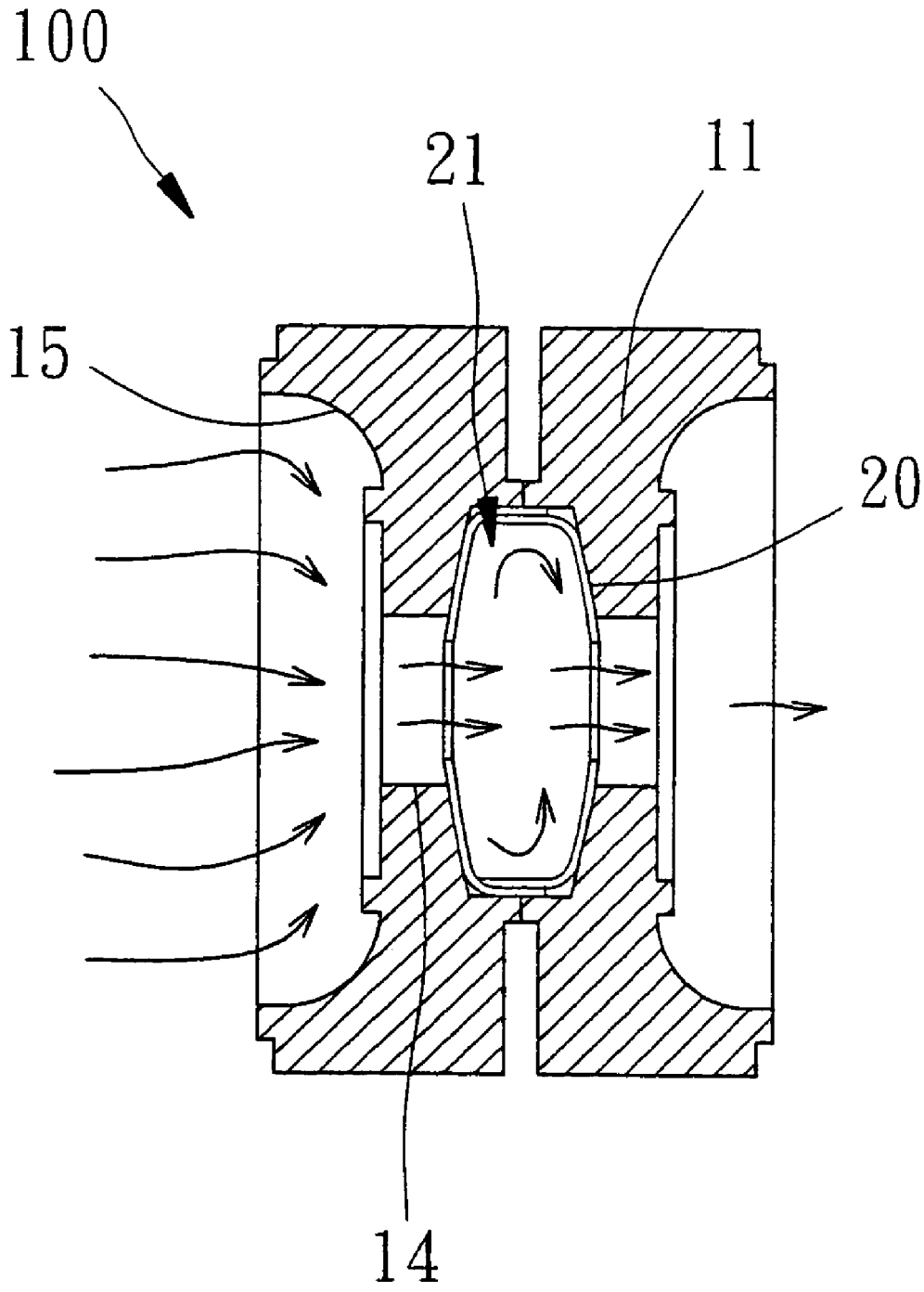
Fig・6

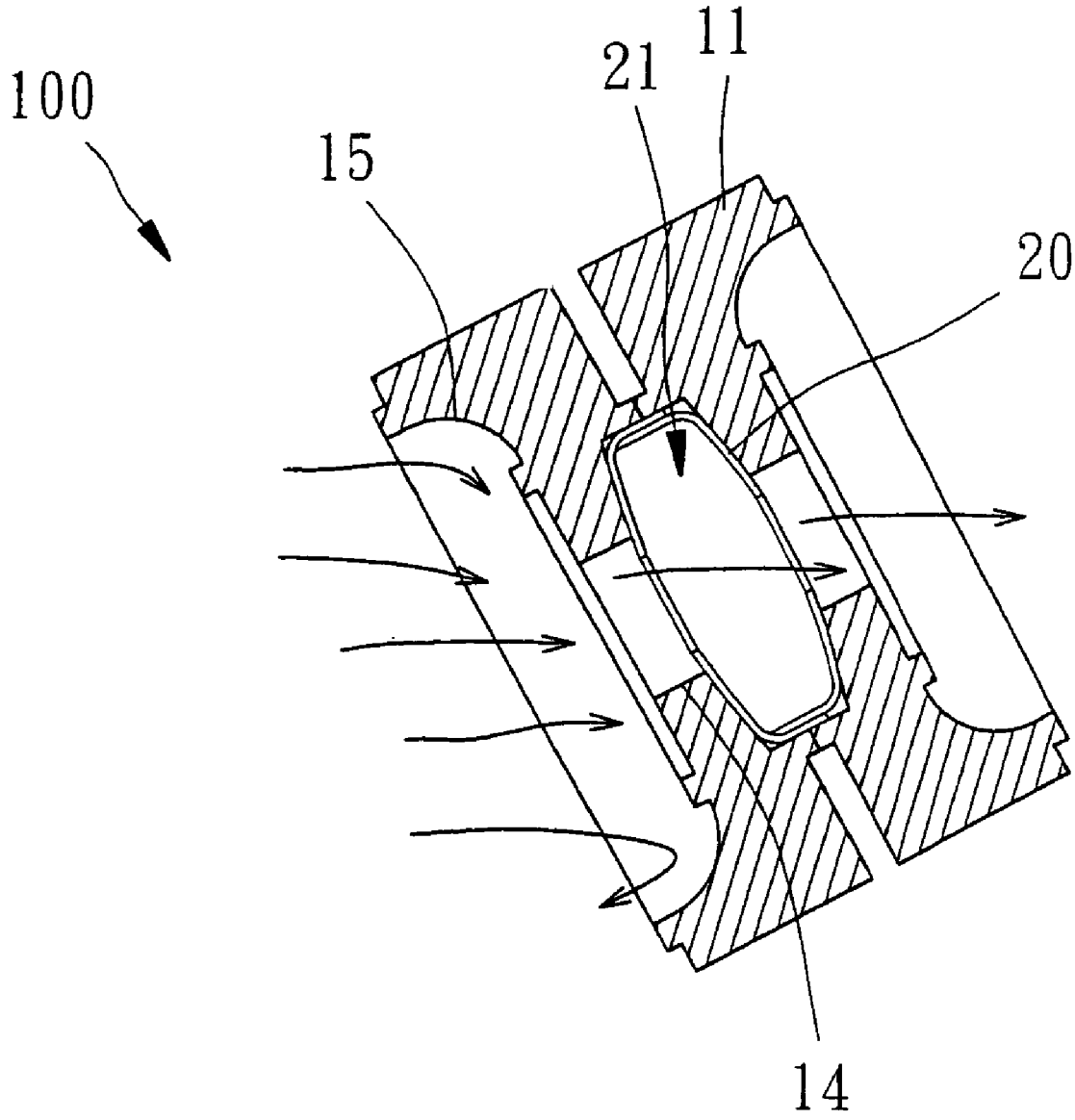
Fig・7

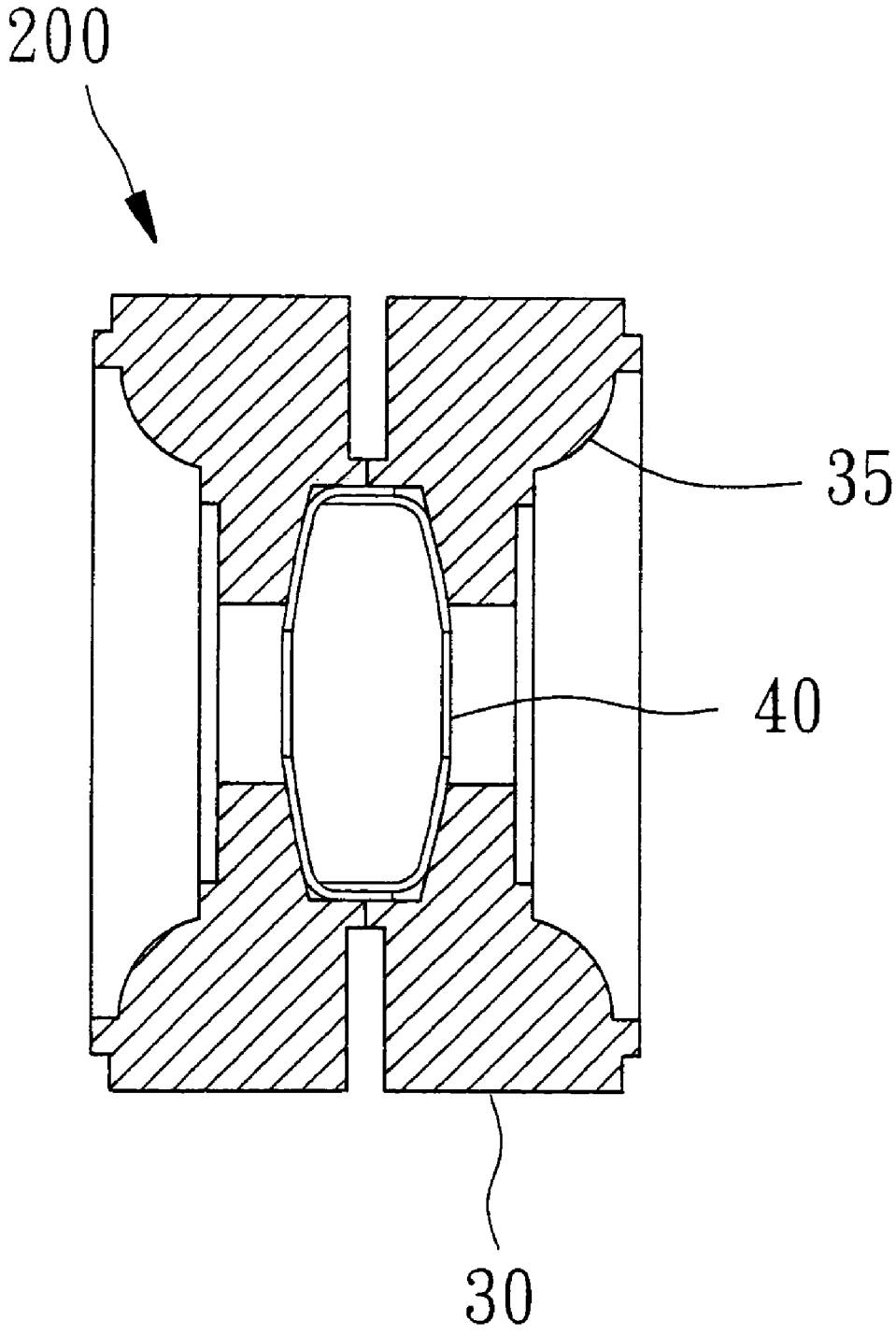
Fig・8

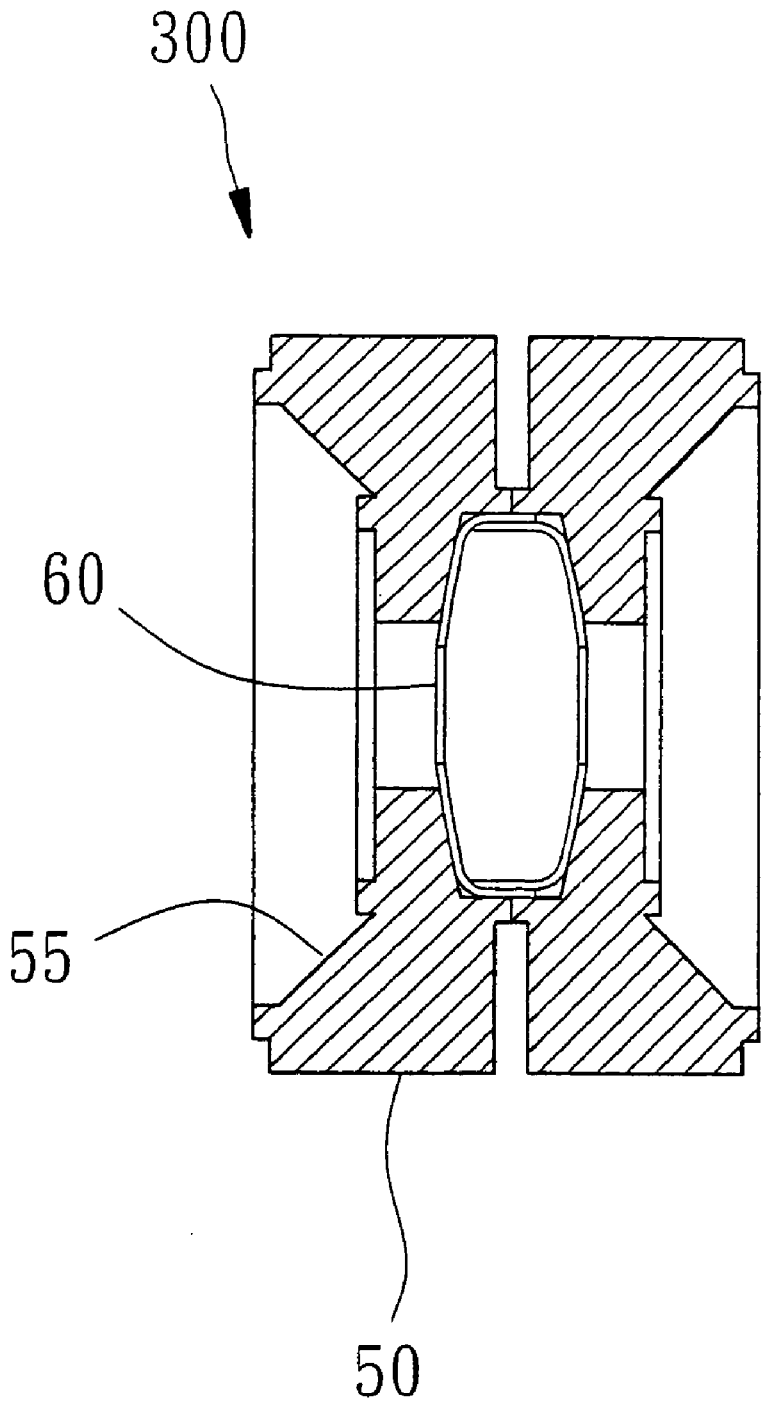
Fig・9

SHOCK ABSORBING AND SOUND PRODUCING DEVICE FOR TENNIS RACKET

BACKGROUND OF THE INVENTION

1. Field of Invention

The present invention relates to rackets and more particularly to a tennis racket having a shock absorbing and sound producing device mounted in its network such that not only shock transmitted to the hand of a player holding the handle is greatly reduced but also it is useful for training children or teenagers in learning how to correctly play tennis by hearing sound produced thereby.

2. Related Art

It is known that the hand of a player (e.g., tennis player) may feel the strong force of shocks after hitting a ball. This is because reaction to the hitting transmits from the network of a racket to the hand holding the handle of the racket. As such, the player may feel a degree of discomfort.

The present invention described later is an outgrowth of earlier work by the inventor hereof, described in U.S. Pat. No. 7,014,579, the teachings of which are incorporated herein by reference. The patent has been successfully used in a commercial application, though improvements are always desirable.

SUMMARY OF THE INVENTION

It is therefore an object of the present invention to provide a device mountable in a tennis racket, comprising a hollow cylindrical cushioning member including an annular groove, a central chamber, an axial channel crossed the chamber, and two recesses at both ends of the cushioning member; and a rigid, doughnut-shaped, hollow sound producing member mounted in the chamber and including an enclosed space and an axial tunnel therethrough, the tunnel being communication with both ends of the channel, wherein three straight wires of a network of the tennis racket pass three sides of the groove for fastening the device in an open space of the network such that the device is adapted to absorb reaction when a ball is hit by the tennis racket; and wherein the strength of sound produced by the device is determined by whether air flowing through one recess, one end of the channel, and the tunnel coacts with air in the space of the sound producing member to produce resonance or not by whether a handle of the tennis racket held by the hand of a tennis player correctly hits the ball or not.

In one aspect of the present invention each recess has a concave, a convex, or an inclined section around its central portion.

In another aspect of the present invention the device is disposed in the network either proximate the handle or proximate a tip of a frame of the tennis racket.

The above and other objects, features and advantages of the present invention will become apparent from the following detailed description taken with the accompanying drawings.

BRIEF DESCRIPTION OF THE DRAWINGS

FIG. 1 is an exploded view of a first preferred embodiment of shock absorbing and sound producing device for tennis racket according to the present invention;

FIG. 2 is a longitudinal sectional view of the device;

FIG. 3 is a longitudinal sectional view of the assembled device;

FIG. 4 is a perspective view of a first configuration of the device mounted in the network of a tennis racket proximate the handle;

FIG. 5 is a perspective view of a second configuration of the device mounted in the network of a tennis racket distal the handle;

FIG. 6 is a view similar to FIG. 3 with paths for air flow through the device being shown when the racket handle held by a tennis player correctly hits a ball;

FIG. 7 is a view similar to FIG. 3 with paths for air flow through the device being shown when the racket handle held by a tennis player incorrectly hits a ball;

FIG. 8 is a longitudinal sectional view of a second preferred embodiment of shock absorbing and sound producing device for tennis racket according to the present invention; and FIG. 9 is a longitudinal sectional view of a third preferred embodiment of shock absorbing and sound producing device for tennis racket according to the present invention.

DETAILED DESCRIPTION OF THE INVENTION

Referring to FIGS. 1 to 7, a shock absorbing and sound producing device 100 mounted in a tennis racket 90 in accordance with a first preferred embodiment of the present invention is shown. The device 100 comprises an integral cushioning unit 10 formed of an elastomeric material. The cushioning unit 10 comprises a hollow cylindrical body 11, an annular groove 12 provided around the body 11 for dividing the body 11 into two halves, a central chamber 13 within the body 11, an axial channel 14 crossed the chamber 13 and communicated therewith, and two bowl-shaped recesses 15 at both ends of the body 11, each recess 15 having a concave section around its central portion.

The device 100 further comprises a doughnut-shaped, hollow sound producing unit 20 formed of rigid material. The sound producing unit 20 comprises a circular enclosed space 21 and an axial tunnel 22 therethrough. The sound producing unit 20 is mounted in the chamber 13 which has its wall elastically deformed as shown in FIG. 3. Also, the tunnel 22 is communication with both ends of the channel 14.

As shown in FIG. 4, the device 100 is fastened in an open space of the network 91 of the tennis racket 90 proximate the handle with three straight elastic wires of the network 81 passing three sides of the groove 12. Alternatively, the location of the device 100 is fastened in an open space of the network 91 of the racket 90 proximate the tip of a frame with three straight elastic wires of the network 81 passing three sides of the groove 12 (see FIG. 5). In either case, the device 100 is able to absorb much reaction when a ball is hit by the racket 90 in a tennis game. As such, shock transmitted to the hand of a player holding the handle is greatly reduced.

As shown in FIG. 6, paths for air flow (as indicated by arrows) through the device 100 are shown when the racket handle held by a tennis player correctly hits a ball. It is seen that a plurality of paths for air flow come through one recess 15 prior to entering one end of the channel 14 with concentration. Next, the paths for air flow leave the channel 14 to pass the tunnel 22. A resonance is produced when the paths for air flow passing the tunnel 22 co-act with air in the space 21. Eventually, the paths for air flow leave the device 100 after passing the other end of the channel 14 and the other recess 15 sequentially.

As shown in FIG. 7, paths for air flow (as indicated by arrows) through the device 100 are shown when the racket handle held by a tennis player incorrectly hits a ball. It is seen that a plurality of paths for air flow come through one recess 15 prior to entering one end of the channel 14 without concentration (i.e., insufficient air flow as indicated by one path for air flow). Next, the path for air flow leaves the channel 14 to pass the tunnel 22. No resonance is produced when the path for air flow passing the tunnel 22 co-acts with air in the space 21. Eventually, the path for air flow leave the device 100 after passing the other end of the channel 14 and the other recess 15 sequentially. As a result, only a small sound or even no sound is produced by the device 100.

It is contemplated by the present invention that a tennis player can adjust an angle of the racket 90 hitting a ball by hearing the strength of sound produced by the device 100. In short, either resonance is produced when the racket 90 correctly hits the ball or a small sound or even no sound is produced when the racket 90 incorrectly hits the ball. This is particularly useful for training children or teenagers in learning how to correctly play tennis.

Referring to FIG. 8, a shock absorbing and sound producing device 200 for tennis racket in accordance with a second preferred embodiment of the present invention is shown. The second embodiment is identical to the first embodiment, except that each recess 35 of the cushioning unit 30 has a convex section around its central portion.

Referring to FIG. 9, a shock absorbing and sound producing device 300 for tennis racket in accordance with a third preferred embodiment of the present invention is shown. The third embodiment is identical to the first embodiment, except that each recess 55 of the cushioning unit 50 has an inclined section around its central portion.

While the present invention herein disclosed has been described by means of specific embodiments, numerous modifications and variations could be made thereto by those skilled in the art without departing from the scope and spirit of the invention set forth in the claims.

What is claimed is:

1. A device mountable in a tennis racket, comprising:

a hollow cylindrical cushioning member including an annular groove, a central chamber, an axial channel crossed the chamber, and two recesses at both ends of the cushioning member; and a rigid, doughnut-shaped, hollow sound producing member mounted in the chamber and including an enclosed space and an axial tunnel therethrough, the tunnel being communication with both ends of the channel, wherein three straight wires of a network of the tennis racket pass three sides of the groove for fastening the device in an open space of the network such that the device is adapted to absorb reaction when a ball is hit by the tennis racket; and wherein the strength of sound produced by the device is determined by whether air flowing through one recess, one end of the channel, and the tunnel co-acts with air in the space of the sound producing member to produce resonance or not by whether a handle of the tennis racket held by the hand of a tennis player correctly hits the ball or not.

2. The device of claim 1, wherein each recess has a concave section around its central portion.

3. The device of claim 1, wherein each recess has a convex section around its central portion.

4. The device of claim 1, wherein each recess has an inclined section around its central portion.

5. The device of claim 1, wherein the device is disposed in the network proximate the handle.

6. The device of claim 1, wherein the device is disposed in the network proximate a tip of a frame of the tennis racket.

* * * * *